US011713157B2

(12) United States Patent
Cernokus et al.

(10) Patent No.: US 11,713,157 B2
(45) Date of Patent: Aug. 1, 2023

(54) PACKAGING WITH HANDLE COMPENSATION

(71) Applicant: APPLE INC., Cupertino, CA (US)

(72) Inventors: Evan A. Cernokus, Campbell, CA (US); Chris Caniglio, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 578 days.

(21) Appl. No.: 16/774,042

(22) Filed: Jan. 28, 2020

(65) Prior Publication Data

US 2021/0061514 A1 Mar. 4, 2021

Related U.S. Application Data

(60) Provisional application No. 62/895,840, filed on Sep. 4, 2019.

(51) Int. Cl.

| | |
|---|---|
| ***B65D 5/64*** | (2006.01) |
| ***B65D 5/468*** | (2006.01) |
| ***B65D 81/02*** | (2006.01) |
| ***B65D 63/16*** | (2006.01) |
| ***B65D 5/44*** | (2006.01) |

(52) U.S. Cl.

CPC ..... *B65D 5/643* (2013.01); *B65D 5/4608* (2013.01); *B65D 63/16* (2013.01); *B65D 81/022* (2013.01); *B65D 5/445* (2013.01)

(58) Field of Classification Search

CPC ..... B65D 5/643; B65D 5/4608; B65D 63/16; B65D 81/022; B65D 5/68; B65D 5/445; B65D 25/102; B65D 5/5028; B65D 77/20; B65D 5/46016; B65D 71/02; B65D 88/1681; B65D 2519/00502; B65D 2519/00711; B65D 33/14

USPC .... 229/125.37, 125.21, 125.22, 125.29, 199, 229/125.38, 117.25; 206/521, 428, 591; 220/315, 770; 24/163 R; 294/152, 158, 294/165

See application file for complete search history.

(56) References Cited

U.S. PATENT DOCUMENTS 1,922,354 A * 8/1933 Burke ..... B65D 5/68 229/199
2,771,237 A * 11/1956 Philipson ..... B65D 5/68 229/120.32

(Continued)

FOREIGN PATENT DOCUMENTS

EP 2724958 B1 2/2016

*Primary Examiner* — Christopher R Demeree
(74) *Attorney, Agent, or Firm* — Sterne, Kessler, Goldstein & Fox P.L.L.C.

(57) ABSTRACT

Packaging is provided including an upper lid having a handle disposed within a channel of a surface of the upper lid and vertically movable within the channel. A lower base box is coupled to the handle via a strap, such that a lifting force imparted to the handle lifts the lower base box when the strap becomes taut. The vertical movement of the handle within the channel overcomes any slack in the strap such that the handle does not contact an upper vertical surface in the upper lid, but a gapless interface between the upper lid and lower base box is maintained during lifting of the packaging. The strap is detachable from the handle and from the base box, such that it may be removed in order to open packaging by lifting the lid off of the base box.

18 Claims, 4 Drawing Sheets

(56) References Cited

U.S. PATENT DOCUMENTS

| | | | | |
|---|---|---|---|---|
| 2,822,973 | A * | 2/1958 | Armstrong | B65D 5/68 229/125.21 |
| 5,192,134 | A | 3/1993 | Polett | |
| 5,565,283 | A | 10/1996 | Chalasani et al. | |
| 5,878,946 | A | 3/1999 | Frerot et al. | |
| 5,897,051 | A * | 4/1999 | Tessier | B65D 71/02 229/199 |
| 2007/0063007 | A1* | 3/2007 | Campbell | B65D 5/445 229/125.21 |
| 2013/0082132 | A1* | 4/2013 | Gaul | B65D 85/672 242/550 |
| 2020/0010236 | A1* | 1/2020 | Sollie | B65D 5/12 |

* cited by examiner

PACKAGING WITH HANDLE COMPENSATION

CROSS-REFERENCE TO RELATED APPLICATIONS

The present application claims the benefit of U.S. Provisional Patent Appl. No. 62/895,840, filed Sep. 4, 2019, titled "Packaging With Handle Compensation," which is incorporated herein by reference in its entirety.

FIELD

The described embodiments relate generally to packaging having a split box design, for example a packaging configuration that may be used when a product is sufficiently heavy such that it is difficult to lift. A lower base box is provided to receive at least a portion of a product, including for example cushioning elements, accessories, product literature, etc. An upper lid provides closure to the lower base box, such that the product is wholly enveloped within the packaging, but can be lifted off of the lower base box such that product is accessible.

More particularly, the present embodiments relate to packaging having a split box design using a handle compensation mechanism to maintain closure of the upper lid in the lower base box during lifting of the packaging, and providing appropriately placed handles in view of the heavy load.

BACKGROUND

Packaging for consumer products may be an important marketing tool used to attract and retain customers. Packaging should be aesthetically appealing, but at the same time direct a customer's attention to the product it is designed to hold. Structural and environmental considerations may play a role in designing packaging. For example, packaging may be designed to be environmentally friendly—while retaining sufficient structure to ensure robust protection for the products contained within it. Consumer comfort may also play a role in packaging design, particularly in the case of products that are heavy.

SUMMARY

Packaging is provided including an upper lid having a handle disposed within a surface of the upper lid and vertically movable (e.g., a translation motion) within the channel. A lower base box is coupled to the handle via a strap, such that a lifting force imparted to the handle lifts the lower base box when the strap becomes taut. The height of the upper lid and lower base box may be substantially equal. The vertical movement of the handle within the channel overcomes any slack in the strap such that the handle does not contact an upper horizontal surface in the upper lid, and a gapless interface between the upper lid and lower base box is maintained during lifting of the packaging. The strap is detachable from the handle and from the base box, such that it may be removed in order to open packaging by lifting the upper lid off of the base box.

The handle is vertically movable such that slack between the connection of the handle and lower base box is absorbed when the strap is taut thereby allowing the handle to lift the lower base box with the upper lid being supported by the lower base box. The strap may be partially disposed on an interior of the upper lid, and extends to be attached to the lower base box. The handle may be removable from the upper lid (e.g., it may be attached to the handle with a perforated tear strip). The strap may be formed from two separate strap portions, one connected to the handle, and one connected to the lower base box, connecting in the middle via a ring.

Each of the upper lid, lower base box, and handle may be made from a cellulose-based material. The packaging may include a support wall fixed to the interior of the lower base box and configured to provide lateral support to the sidewalls of the lower base box, and configured to provide lateral support to the sidewalls of the upper lid when the packaging is in a closed configuration. The support wall may also be formed from a cellulose-based material.

In some embodiments, packaging may include a cushioning element, which may include a corrugate. The corrugate may be formed from a cellulose-based material, and may include a planar element interposed between serpentine elements to limit deflection of the serpentine elements (e.g., when absorbing a force). Further, in some embodiments the cushioning element includes and upper panel and a lower panel that cooperate together to form an airflow aperture to dampen movement of the corrugate.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1A:
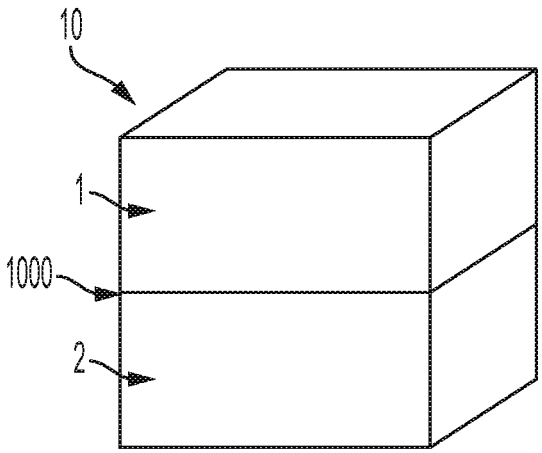
FIG. 1A shows packaging in a closed configuration, having no handle compensation mechanism.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Product packaging is an integral part of a customer's experience. It introduces the customer to their product, and can affect the customer's feelings toward the product and the company that created it. Seamless and solid-feeling packaging without unnecessary gaps between edges and components—calling to mind a unitary construction with robust character—may be particularly desirable. This may be particularly true in the case of heavy products, where environmentally friendly packaging may be challenging to implement due to heavy loads. Indeed, during unboxing of a heavy or large product, positioning how high a consumer must lift the product to remove it from the packaging can affect a user's comfort and ease of unpacking their product.

Moreover, having a split box configuration allows for the consumer to lift the heavy or large product less than the complete height of the packaging to remove the product from the packaging. This is in contrast to packaging that may have a single opening point at the top of the packaging. Positioning a split box configuration in between a lower base box and an upper lid is further advantageous relative to packaging that may rely on a pedestal type base, requiring a customer to lift a lid over the complete height of a large product to remove the product from the packaging. In cases of large and heavy products, packaging components generally become more heavy such that a balance between the position of the opening between the lower base box and the upper lid relative to the height of the overall packaging (i.e., the position of the interface at which the lower base box and the upper lid meet) can assist a user's ability to lift the packaging when the product is still within the packaging.

Packaging should be aesthetically appealing, but at the same time direct a customer's attention to the product it is designed to hold. Packaging having gaps, defects, or imperfections can draw the customer's attention away from the product it is holding or make the product seem less appealing. For example, if a split box configuration packaging is lifted, but there is a gap between the lower base box and upper lid, this may draw the customer's attention away from the product. In some cases, packaging may include handles to help a user carry the packaging. In order to be easily accessible to a user, the handles may be in the upper lid. However, in order avoid simply lifting the upper lid off of the lower base box, the upper lid may be connected to the lower base box in such a way that the user's carrying force is transmitted across the interface between the upper lid and the lower base box. For example, the upper lid and lower base box may be connected to one another via one or more straps extending across the interface between the upper lid and the lower base box and directly fixed to each of the upper lid and the lower base box. However, a strap may stretch, allowing for some separation between the upper lid and the lower base box when the packaging is lifted by the upper lid. This can create an unsightly gap between the upper lid and the lower base box, and can detrimentally affect the stability of the packaging (e.g., making it more prone to deformation).

Companies may also be sensitive to the cost of packaging and may wish to promote packaging that is eco-friendly. Optimization of packaging in material usage may help keep costs low, and if done well may not interfere with, and may promote, a positive user experience. Packaging made out of recyclable and/or biodegradable materials, such as paper or other cellulose-based products can reduce environmental impact. Packaging that is interesting in character and well-executed may boost a product's or a brand's reputation, thereby attracting new customers and retaining previous customers.

Packaging described in this document achieves these and other beneficial characteristics by balancing structural robustness, eco-friendly materials, and aesthetic elements, particularly in a previously challenging environment of packaging for large or heavy products.

In some embodiments, packaging is formed from two generally equal box halves, situated vertically relative to each other. This allows for a shorter travel distance of the upper half of the box, when lifting the upper half of the box away to reveal a product within the packaging. Handles are provided, connected to a suspension system that helps to compensate for large or heavy products within the packaging. In some embodiments, the suspension mechanism suspension mechanism removably couples the two generally equal box halves. The handle may be attached to the suspension mechanism, which may be a strap, and is allowed to travel vertically to pull the strap taut and thereby lift a lower half of the packaging.

The handle and suspension mechanism present a finished, clean, flawless appearance, and increases structural integrity and comfort when lifting the packaging. If the straps are made from a different material from the rest of the packaging, for example a non-recyclable material, they may be permanently removed from the lower half of the box and the handle as described herein. The suspension mechanism may also be removably coupled such that if the product is to be repackaged, the suspension mechanism may be reattached to packaging.

To keep the product protected and secure during transport, handling, or storage, the packaging may include additional packaging components such as, for example, cushioning elements as described herein to protect the product. Such additional packaging components may further enhance the structural integrity of the packaging and add support when a product is in transit within packaging. The suspension mechanism, handles, cushioning, and recycled material balance each of the aforementioned goals—including eco-friendliness, aesthetic design, structural robustness, cost, and ease of manufacturing.

These and other embodiments are discussed below with reference to the accompanying figures. However, those skilled in the art will readily appreciate that the detailed description given herein with respect to these figures is for explanatory purposes only and should not be construed as limiting.

Figure 1B:
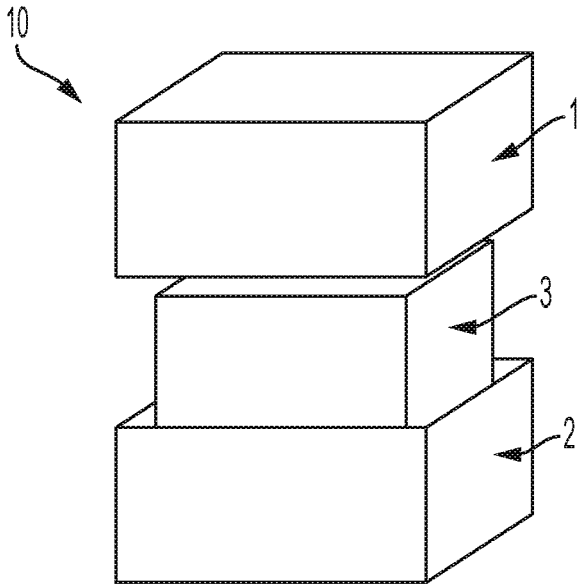
FIG. 1B shows the packaging of FIG. 1A in an open configuration.

FIG. 1A shows a closed configuration of packaging 10 and FIG. 1B shows an open configuration of packaging 10, showing product 3 within packaging 10. As shown in the figures, packaging 10 includes lower base box 2 and upper lid 1, operating together such that product 3 is held within packaging 10. In some embodiments, the split 1000 at which lower base box 2 and upper lid 1 meet may divide packaging 10 in half, that is, the height of each of the two halves of packaging 10 is about 50% of the height of the entire finished, closed packaging. In some embodiments, the split 1000 may be positioned within the middle third of the overall height of packaging 10 when packaging 10 is in the closed position. When packaging 10 is made from recyclable materials, such as cardboard, paperboard, paper, or other cellulose-based materials, sufficient structural rigidity of the sidewalls of lower base box 2 and upper lid 1 may be difficult to achieve. As such, if the user attempts to carry packaging 10, or lift upper lid 1 away to expose product 3, the sidewalls of one or both of the halves of packaging 10 may bow inward. This may induce unwanted stress upon product 3 housed in packaging 10, damage packaging 10, or be otherwise undesirable.

Figure 2A:
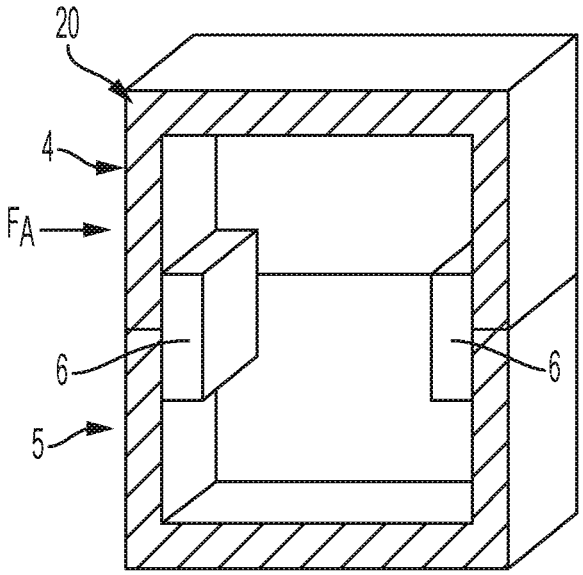
FIG. 2A shows packaging having in a closed configuration, having block supports but no handle compensation mechanism.

Turning to FIG. 2A, packaging 20 is shown. The figure shows a cross-sectional perspective, showing the interior of packaging 20 without a product inside, for visualization purposes. Packaging 20 is similar in construction as packaging 10; however packaging 20 additionally includes support walls 6. Support blocks 6 may be fixed to lower base box 5 or upper lid 4, for example. In some embodiments, support walls described herein may be disposed around the entire interior perimeter of packaging 20. In some embodiments, the support walls may be positioned at least one per side, to cooperate in limiting side-to-side movement. In some embodiments, the side support may take another form, for example a rim or other structure that forms a bearing surface, against which the inner side of the upper lid contacts in the closed position of the packaging.

Figure 2B:
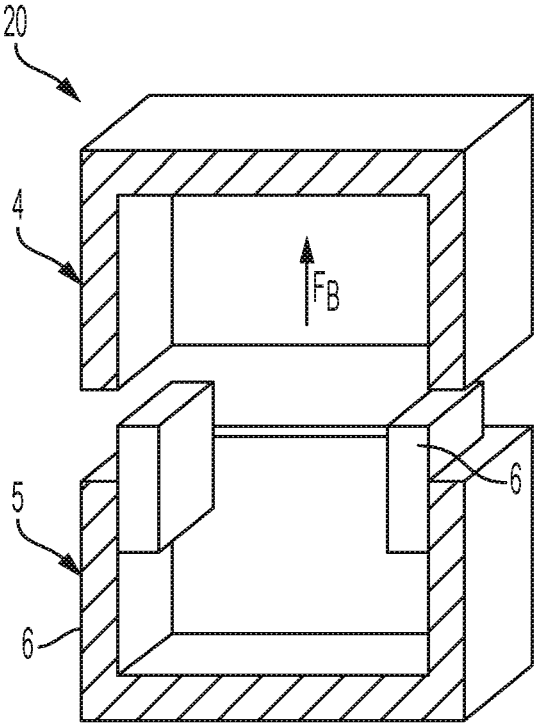
FIG. 2B shows the packaging of FIG. 2A in an open configuration.

FIG. 2A shows a closed configuration of packaging 20, and FIG. 2B shows an open configuration of packaging 20. As seen from the closed configuration, if a lateral force $F_A$ is applied (e.g., in shipping or handling of packaging 20) lid, support walls 6 provide additional structural integrity and resist lateral motion of upper lid 4 relative to lower base box 5, keeping upper lid 4 and lower base box 5 aligned in the closed configuration. Thus packaging 20 is not opened by a lateral force $F_A$. Vertical force $F_B$, on the other hand is shown to denote an upwards force applied by a user to lift upper lid 4. As can be seen from FIG. 2, support walls 6 do not impede vertical motion of upper lid 4, thus allowing a user to remove upper lid 4 from lower base box 5.

FIG. 3 shows packaging 30. The figure shows a cross section of the interior of packaging 30 without a product inside, for visualization purposes. Packaging 20 is of similar construction as packaging 10 and packaging 20, however packaging 30 additionally includes handles 306 disposed in upper lid 300, and an suspension mechanism 307 to connect upper lid 300 and lower base box 302. Handles 306 allow a user to lift the packaging 30 from a higher point on the packaging, increasing a user's ease and comfort in lifting and opening packaging 30. Suspension mechanism 307 may be, for example, a strap, for example, a woven polyethylene ("PET") strap. In some embodiments, the strap may be made of other materials, such as a cellulose-based material. In some embodiments the strap may be metal, rubber, or paper, webbing, plastic webbing, seat belt material, etc. Suspension mechanism 307 may be coupled at fixed points to upper lid 300 and lower base box 302, for example using adhesive or another mechanism, such as a hook and loop, or buckle attachment. In order to lift upper lid box 300 away to access a product within lower base box 302, suspension mechanism 307 may be separable from one or both of lid 300 and base box 302. Support blocks 304 are included and are configured similarly to support walls 6 (e.g., they may be fixed to lower base box 302 or upper lid 300 and, for example an support structural integrity of packaging 30 during application of force).

Figure 3A:
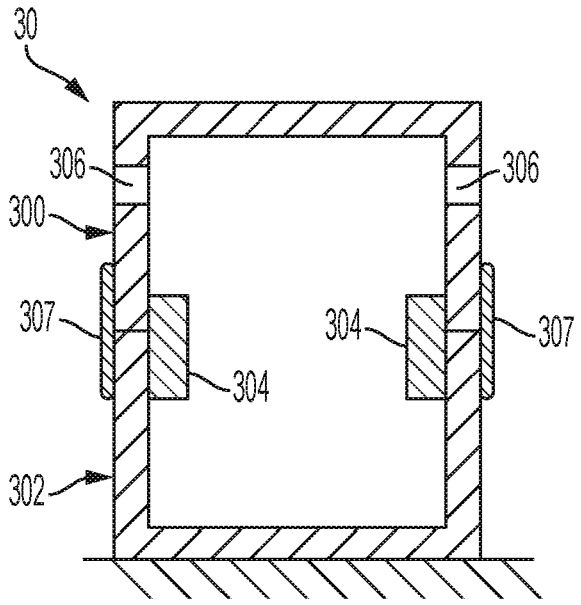
FIG. 3A shows packaging in a closed configuration, having block supports and a strap connecting the two halves of the packaging.
Figure 3B:
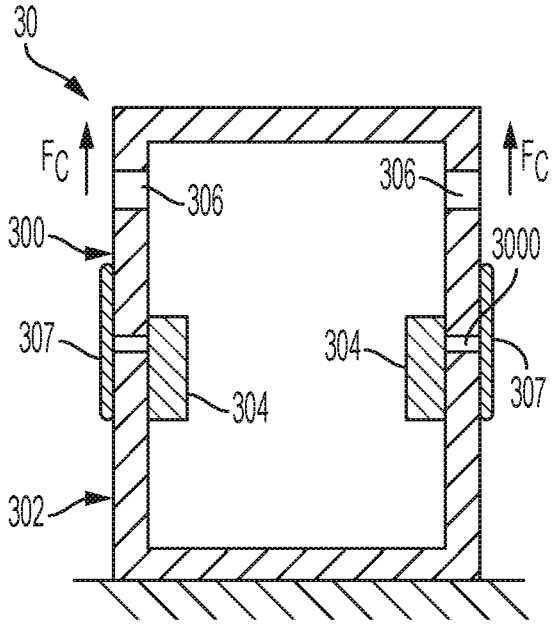
FIG. 3B shows the packaging of 3A in an open configuration.

FIG. 3A shows a closed configuration of packaging 30, and FIG. 3B shows a lifted, yet closed, configuration of packaging 30 is shown on the right. As seen from the lifted configuration, if a user imparts a force $F_C$ at handles 306 in order to lift packaging 30, if the suspension mechanism 307 stretches, an undesirable gap 3000 between upper lid 300 and lower base box 302 may form. Additionally, a user lifting packaging 30 from handles 306 may expect a lighter load if they perceive upper lid 300 traveling upward prior to any slack in suspension mechanism 307 being taken up, such that it is a surprise when the full load is transferred between lower base box 302 and upper lid 300. Further, the distance now between upper lid 300 and lower base box 302 (at gap 3000) reduces the contact between upper lid 300 and lower base box 302. Lower meeting surface of upper lid 302 and upper meeting surface of lower base box 302 are no longer in contact, separated by gap 3000. Further, the amount of contact between interior sides of upper lid 300 and support walls 304 is reduced. This reduction in contact between upper lid 300 and lower base box 302 decreases the overall stability of packaging 30.

Figure 4A:
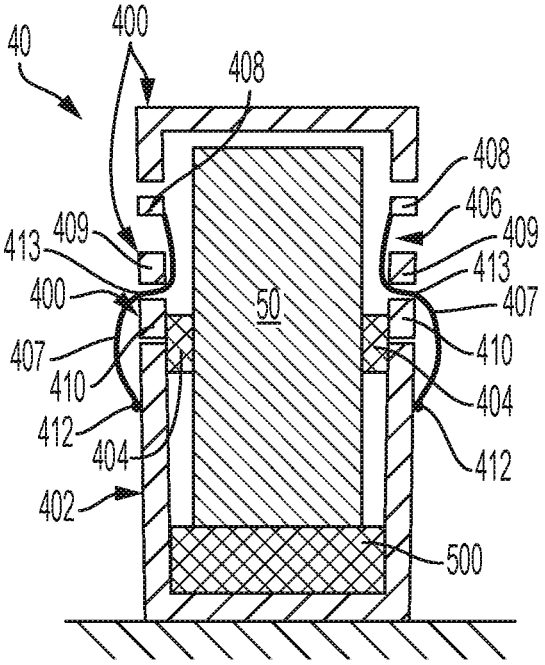
FIG. 4A shows packaging in a closed configuration, having block supports and a handle compensation mechanism.

FIG. 4A shows packaging 40. The figure shows a cross section the interior of packaging 40 without a product inside, for visualization purposes. Packaging 40 is of similar construction as packaging 10/20/30, however packaging 40 additionally includes handles 408 and suspension mechanism 405 (which also serves as a suspension mechanism) suspension mechanism. Packaging 40 may also include support walls 404 as in packaging 20/30.

Figure 7:
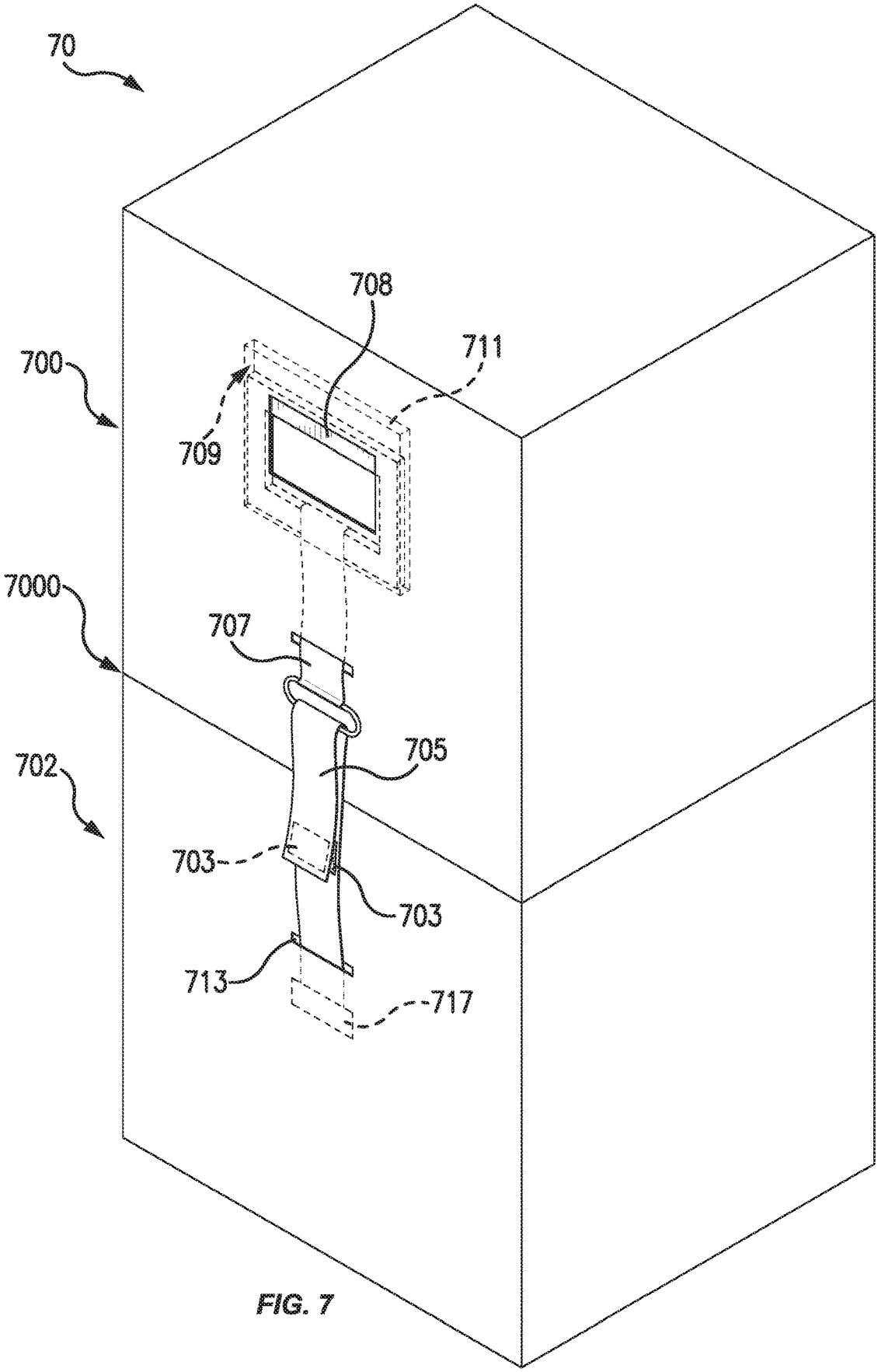
FIG. 7 shows a detail view of an exemplary handle compensation mechanism, that may be used in packaging such as that shown in FIGS. 4A and 4B.

Handles 408 are disposed in upper lid 400, and travel within a channel defined by an inner and outer portion of upper lid 400 (rather than simply being an aperture as shown in FIG. 3). A detailed view of this feature is shown in FIG. 7, described herein. Suspension mechanism 405 connects upper lid 400 and lower base box 402. Handles 408 allow a user to lift the packaging 40 from a higher point on the packaging, and increases the user's ease and comfort in lifting and opening packaging 40. As with suspension mechanism 307, suspension mechanism 405 may be, for example a strap. Suspension mechanism 405 may be adhered to handle 408 (rather than upper lid 400) and lower base box 402.

In some embodiments, suspension mechanism 405 is separable from lower base box 402 such that upper lid 400 may be lifted off to access product 50. Such separability may be effected, for example through a hook and loop fastening system, whereby suspension mechanism 405 loops through a ring (see FIG. 7) for example and attaches to itself, thereby coupling suspension mechanism 405 to lower base box 402. At the handle 408 side, suspension mechanism 405 may be connected to handle 408, for example via adhesives secured by a perforated tear strip. In this way, suspension mechanism 405 may be re-attachable at base box 402, while at handle 408, in order to dispose of packaging 40, suspension mechanism 405 may be permanently severed from handle 408. The two strap portions may remain connected when the packaging is opened by un-doing a hook-and-loop fastener on the lower strap, and sliding the lower strap out of the top end of the ring (to which the upper strap portion is attached). This feature is further described and shown with reference to FIG. 7. Similarly, a bottom portion of the strap 407 may be attached to the lower base box 402 for example via adhesives secured by a perforated tear strip. In general, suspension mechanism 405 is configured as a strap, and may follow a general path from handle 408 on the interior of upper lid 400 around a portion 409 of upper lid 400 through aperture 413 formed in upper lid 400 to the exterior of upper lid 400, and around lower portion 410 of upper lid 400 prior to being attached to lower base box 402 at element 412 as shown in FIG. 4. This configuration maintains positive aesthetics of packaging 40, while enhancing the user experience of both lifting packaging 40 and unboxing packaging 40 to reveal a product 50 within. Further description of this path in an embodiment is shown in FIG. 7. If a user desires to dispose of packaging, there are tear strips to remove both upper and lower straps on each side.

To lift packaging 40, a user may grasp handles 408, disposed within a channel or recess of upper lid 400. As force $F_D$ is applied to handles 408, slack (e.g., stretch, excess material length, etc.) in suspension mechanism 405 is taken up via the distance, vertically, of the channel. In FIG. 4A, slack is represented in FIG. 4A as strap 407 appearing loose, however strap 407 may extend tightly between handle 408 and anchor point 412, and such slack as described may be from stretching of strap 407 under the weight of packaging as it is lifted by the handles. Indeed, strap 407 may be taut in an un-loaded state (e.g., when the packaging is not being lifted) in order to help maintain upper lid 400 and lower base box 402 together, and strap 407 may be tightened through accessible portion of strap 407 (e.g., by re-buckling strap 407). In some embodiments, when packaging 400 is lifted by handles 408 may be floating (e.g., slide with minimal constraint) vertically within the channel such that an upper surface of handle 408 does not contact or transmit force to another portion of upper lid 400 (see also FIG. 7).

Once suspension mechanism 405 is taut in a loaded configuration (i.e., when packaging 400 is lifted) the force applied by the user through handles 408 (i.e., force $F_D$) transfers to the attachment point at element 412 such that packaging 40 may be lifted. This ensures that no gap forms between upper lid 400 lower base box 402, while maintaining an appropriate lifting point with handles 408. Even if suspension mechanism 405 stretches, an undesirable gap between upper lid 400 and lower base box 402 will not form—all slack will be absorbed by handle 408's travel vertically, prior to suspension mechanism 405 becoming taut and beginning to lift lower base box 402. This configuration also avoids a user expecting a lighter load, as upper lid 400 does not begin traveling upward without handles 408 engaging with a taut suspension mechanism 405. In the lifting configuration, the user is effectively carrying the bottom box (leading to more stability) as the bottom box is hanging from the straps. The top box is then simply along for the ride, passively sitting atop the bottom box. This limits the stresses put on the packaging as a whole, and in particular the top box. It avoids the structure of the packaging having to transmit the user's carrying force throughout the whole box, and allows the user to carry the bottom of the box from the top, at a point much higher and separated form an upper edge of the bottom box. This allows the user to carry from a more stable position (low, at the bottom box) while not having to bend over and lift so high increasing user comfort and making carrying easier.

To access products within packaging 40, a lower portion of suspension mechanism 405 may be released from and detached from an upper portion of suspension mechanism 405, allowing separation from lower base box 402. Once detached, a user may simply lift upper lid 400 at any point, including by handles 408. If a user wishes to re-box the product within packaging 40, they may close the lid and reattach suspension mechanism 405 to base box 402.

In some embodiments, each packaging described herein includes two handles and two suspension mechanisms, on opposing sides of the packaging, for equal distribution across the box when lifting, and availability to lift with both hands, etc.

Each of packaging 10/20/30/40 may include cushioning elements to provide additional support to the product within the packaging, for example, at a bottom interior surface of the respective base boxes. Turning to FIG. 5, an example of such a cushion is provided in cushioning component 500. Cushioning component 500 be formed as a corrugated cushioning element, and may include an upper surface 502 and a lower surface 504. In some embodiments, a side surface 506 is included, together with upper surface 502 and lower surface 504 forming a generally U-shaped configuration. Between upper surface 502 lower surface 504, cushion 500 may include serpentine elements 510 and 512, separated by planar element 508. Serpentine elements 510 and 512 may include opposing surfaces 516 that transfer force between serpentine elements 510 and 512 through planar element 508.

Figure 5A:
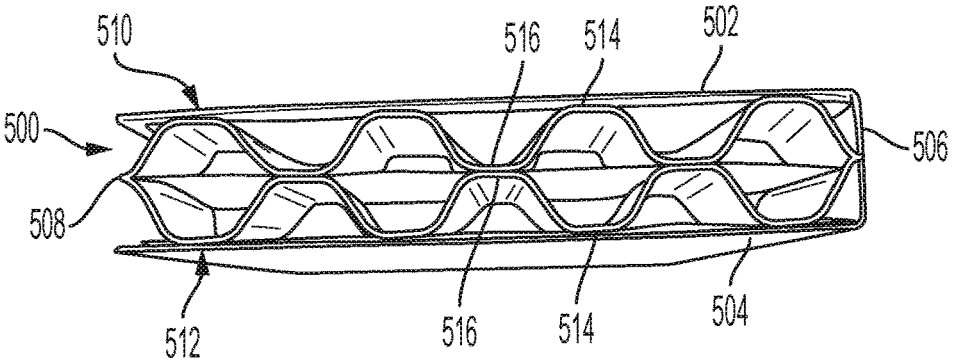
FIG. 5 shows a corrugate structure having an unloaded and a loaded configuration.
Figure 5B:
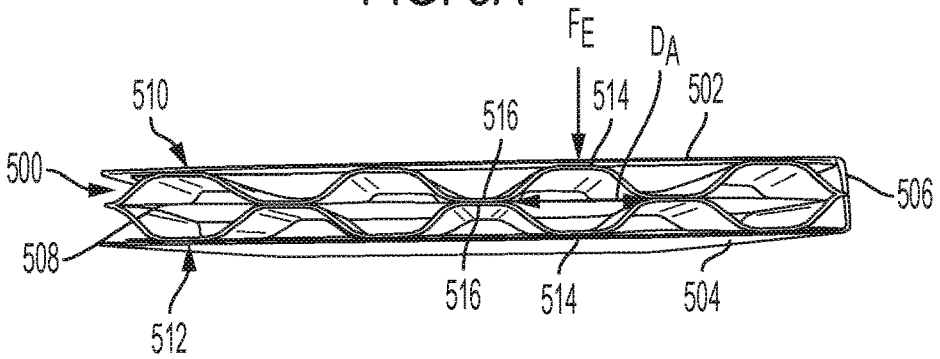

FIG. 5A shows an unloaded configuration and FIG. 5B shows a loaded configuration. As shown in FIG. 5B, as a force $F_E$ is be applied to cushion 500, distance $D_A$ is shown to increase as opposing surfaces 516 deflect along with spaced surfaces 514, as the vertical distance between spaced surfaces 514 decreases via the application of force $F_D$. Planar element 508 is fixed in between the mirrored corrugate structures, and helps to maintain the distance, such that the corrugates do not collapse if they receive an impact load. Planar element 508 helps the load be absorbed without the corrugate deforming to such an extent that it would not go back to its original shape.

Additionally, in some embodiments, the open-air gaps within cushion 500 may act as a damper, damping impact forces that may be applied. As the impact is applied the air pressure within cushion 500 increases, and slows deformation of cushion 500. Additionally, serpentine elements 510 and 512 act as springs, helping to maintain the form of surfaces 502 and 504 and to maintain the structural integrity of cushion 500.

Turning to FIG. 6, cushioning component 600 is shown. The serpentine configuration of cushion 600 is similar to that of cushion 500. In some embodiments, planar element may be omitted. Cushion 600 includes upper component 602 and lower component 608, acting together to hold serpentine elements 612 and 614 together, containing them within a closed pocket of air. As in cushion 500, serpentine elements 612 and 614 include opposing surfaces 618 and spaced surfaces 616. Upper component 602 includes top element 604 and side elements 606, generally forming a U-shaped configuration cross section that partially encloses serpentine elements 612 and 614—the three dimensional structure is configured as a box top. Lower component 608 includes a similar configuration, having side surfaces 610 and lower surface 620. Upper component 602 and lower components 608 may be nested within each other such that side elements 606 and side elements 610 may be adjacent to one another. In this way, serpentine elements 612 and 614 are contained within upper component 602 and lower components 608, held within a closed pocket of air.

Figure 6A:
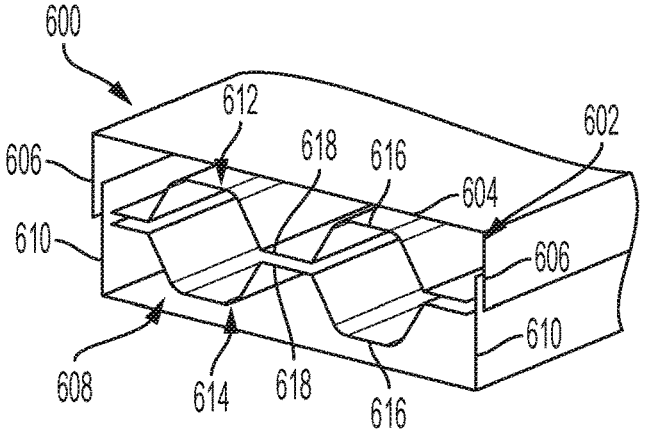
FIG. 6 shows a corrugate structure having an unloaded and a loaded configuration.
Figure 6B:
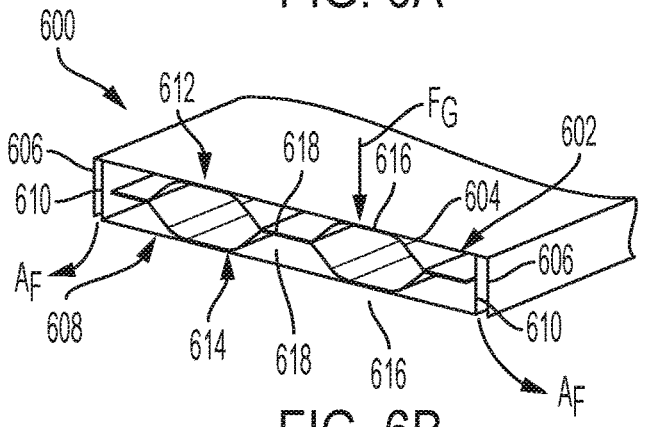

An unloaded configuration is shown in FIG. 6A, and a loaded configuration is shown in FIG. 6B. As shown in the loaded configuration, with force $F_G$ being applied to cushion 600, airflow AF may escape between side elements 606 and 610 in a restricted manner, providing a damping effect. The degree of damping can be tailored depending on how tightly the top and bottom parts of the cushion fit together. As with cushion 500, cushion 600's serpentine elements 612 and 614 act as springs, helping to maintain the form of cushion 600. Elements 612 and 614 are able to maintain their shape with deflection of their middle portions without being flattened—keeping the general serpentine shape is enabled by the damping provided by the air pocket provided by their containing box, similar to the function that the planar element serves for the cushion shown in FIGS. 5A and 5B.

Figure 4B:
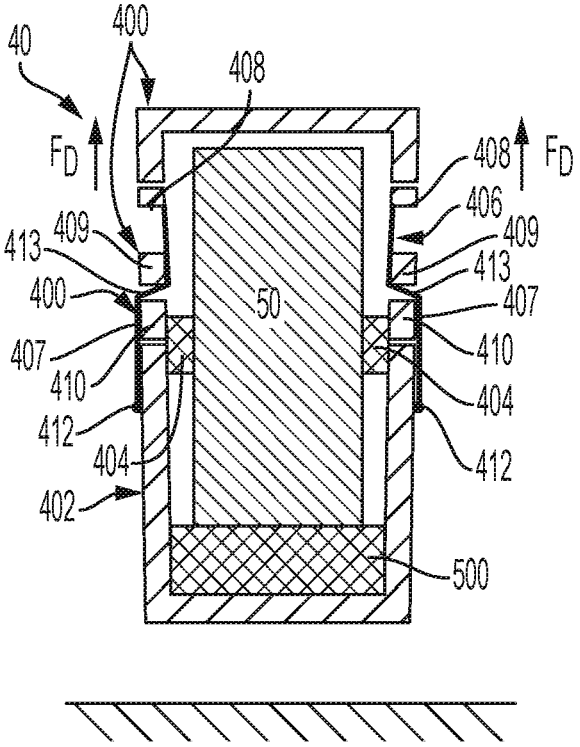
FIG. 4B shows the packaging of 4A in an open configuration.

Turning to FIG. 7, a detailed view of a suspension mechanism is provided in the context of packaging 70, which is a detailed view of the schematic shown in FIGS. 4A and 4B. As shown, packaging 70 includes upper lid 700 and lower base box 702, meeting at split 7000. As shown, handle 708 is disposed within channel 709 formed in top lid 700. It may travel vertically, and may be restrained such that it does not reach upper horizontal surface 711 within channel 709. Strap 707 is attached to handle 708 (e.g., via a tear strip on the interior of the handle accessible from the interior of lid 700), and may pass through an aperture on the exterior of lid 700 as shown. Strap 707 is attached to the ring as shown. Strap 705 may be attached to an interior surface of base box 702 at tear strip 717, for example. Strap 705 may pass through aperture 713 as shown, pass up and be looped through the ring that strap 707 is attached to. Once strap 705 is passed through the ring, it may be cinched tightly and attached to itself, e.g., through a hook-and-loop system 703. Other attachment systems such as snaps, buckles, loops, hooks, etc. are also contemplated. The features and operation discussed with regards to FIGS. 4A and 4B equally apply to FIG. 7.

To lift packaging 70, a user may grasp handles 708, disposed within a channel or recess of upper lid 700. Slack is taken up via the distance, vertically, of the channel. Once the suspension mechanism is taut in a loaded configuration (i.e., when packaging 70 is lifted) the force applied by the user through handles 708 transfers to the attachment point at element 717 such that packaging 70 may be lifted. This ensures that no gap forms between upper lid 700 lower base box 702, while maintaining an appropriate lifting point with handles 708. Even if one or both of the straps stretches, an undesirable gap between upper lid 700 and lower base box 702 will not form—all slack will be absorbed by handle 708's translation vertically, prior to the suspension mechanism becoming taut and beginning to lift lower base box 702. In the lifting configuration, the user is effectively carrying the bottom box (leading to more stability) as the bottom box is hanging from the straps. The top box is then simply along for the ride, passively sitting atop the bottom box. This limits the stresses put on the packaging as a whole, and in particular the top box. It avoids the structure of the packaging having to transmit the user's carrying force throughout the whole box, and allows the user to carry the bottom of the box from the top, at a point much higher and separated form an upper edge of the bottom box. This allows the user to carry from a more stable position (low, at the bottom box) while not having to bend over and lift so high increasing user comfort and making carrying easier.

To access products within packaging 70, the hook-and-loop fastener 703 may be released, strap 705 pulled free of the ring, and lid 700 removed. When packaging 70 is to be disposed of, the tear strips may release straps 707 and 705 from their respective attachment points.

The packaging components described herein may be composed of a recyclable material (e.g., a biodegradable or compostable material). If and when the customer opts to dispose of the packaging, because the entire packaging is recyclable and cellulose-based, the packaging may simply be recycled without requiring material separation (e.g., in a single-stream recycling program). With respect to suspension mechanism 307 or 407, if they are formed of non-cellulose based materials, e.g., a polymer such as woven polyethylene ("PET"), they may be separable from the remainder of the packaging and appropriately disposed of.

Additionally, the packaging may be manufactured in a cost-effective and environmentally-friendly way. In some embodiments, components of packaging 10/20/30/40, or corrugate cushions 500/600 may be constructed of a single integrally-formed piece of material. The single integrally-formed piece of material may be a foldable material that is folded into its final configuration. For example, handles 408 may be formed from folded paper or paperboard, or other cellulose-based materials, such as a general rectangular solid, or a general hollow rectangular solid (see FIG. 7). In some embodiments, the foldable material may be a single piece of material that is cut by a single operation (e.g., a single die-cutting operation). In some embodiments, the foldable material may be die cut from a stock material (e.g., a sheet or roll of material). Single integrally-formed pieces of material that are cut by a single cutting operation may facilitate efficient and reproducible manufacturing. Moreover, such manufacturing may reduce waste by reducing waste material during manufacturing.

Packaging 10/20/30/40 is constructed to give a clean, unitary appearance. This helps to reinforce its high quality and robust character, and that of the product it houses. To achieve this appearance, seams, gaps, and raw material edges are minimized (raw material edges are edges formed by cutting through a flat material, where the substance of the material between its outer flat surfaces is revealed). Packaging may be a particular color, e.g., a brand-identifier color. In some embodiments, visible surfaces of packaging 10/20/30/40 may be predominantly white, a color that cannot easily be achieved in recyclable cellulose-based materials, particularly in less-expensive common greyboard or corrugated cardboard. In some embodiments, the material is not post-treated, e.g., not coated in any additive, etc.

Components of packaging 10/20/30/40 may be formed from a single blank. In some embodiments, the blank is formed of a single continuous substrate, such as, for example cellulose-based material like cardboard or paperboard. Tabs, flaps, and regions without adhesive of the blank are folded such that no adhesive is visible in finished packaging 10/20/30/40. In some embodiments, adhesive may be omitted and the various flaps and tabs attached in another suitable manner (e.g., by mechanical interlock or press fit). Fold lines may be formed, for example, by weakening the substrate along the lines, such as by perforation, material crushing, scoring, miter cutting, etc.

In some embodiments, any surface finishing may take place after the components are cut from the blank, or alternatively prior to the blank being cut into separate sheets for assembling to a final product. Additionally, some operations may be performed concurrently.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not intended to be exhaustive or to limit the embodiments to the precise forms disclosed. It will be apparent to one of ordinary skill in the art that many modifications and variations are possible in view of the above teachings.

What is claimed is:

1. Packaging, comprising:

a lid comprising a handle disposed within a channel of a lid sidewall;

a base box, wherein the lid and base box in a closed configuration enclose a product; and a suspension mechanism, comprising a strap, and removably fixing the handle and base box together such that lifting the handle lifts the base box, wherein the strap is connected to the base box on one end and connected to the handle on the opposite end, wherein the handle is vertically movable within the channel of the lid sidewall, such that slack between the connection of the handle and base box is absorbed when the strap is taut thereby allowing the handle to lift the base box with the lid being supported by the base box.

2. The packaging of claim 1, wherein the strap comprises a first strap attached to the lower base box and a second strap attached to the handle, wherein the first and second straps are configured to couple together such that lifting the handle transmits force to the base box via the first strap.

3. The packaging of claim 1, wherein the strap is partially disposed on an interior of the lid, and passes through the base box to be attached on an exterior of the lower base box.

4. The packaging of claim 1, wherein the handle is constrained within the channel of the lid sidewall, and wherein the strap is removably attached to the handle with a perforated tear strip.

5. The packaging of claim 1, wherein the lid, base box, and handle are each made from a cellulose-based material.

6. The packaging of claim 1, wherein the height of the lid is the same as the height of the base box.

7. The packaging of claim 1, further comprising a support wall fixed to the interior of the base box and configured to provide lateral support to sidewalls of the base box, and configured to provide lateral support to the sidewalls of the lid when the packaging is in a closed configuration.

8. The packaging of claim 1, further comprising a cushioning element disposed on an interior bottom surface of the base box, the cushioning element comprising a corrugate comprising:

an upper panel and a lower panel cooperating to retain first and second serpentine elements configured to absorb force at opposing surfaces; and a planar element disposed the first and second serpentine elements such that the first and second serpentine elements are restrained to maintain their serpentine shape in the event of an impact.

9. Packaging, comprising:

a lid comprising a handle disposed within a channel of a lid sidewall, the handle vertically movable within the channel; and a base box coupled to the handle via a strap, such that a lifting force imparted to the handle lifts the lower base box when the strap becomes taut, wherein the strap comprises:

a first strap attached to the handle on one end and a ring on the opposing end; and a second strap attached to the base box on one end and passing through the ring on the opposing end such that it may be attached to itself.

10. The packaging of claim 9, wherein the vertical movement of the handle within the channel overcomes any slack in the strap such that the vertical movement is limited only by the strap.

11. The packaging of claim 9, wherein the length of the second strap is adjustable via the hook-and-loop system.

12. The packaging of claim 9, wherein the lid and base box fully envelop the product when in a closed configuration, and form a gapless interface between the base box and lid in a closed configuration.

13. The packaging of claim 9, wherein the upper lid, lower base box, and handle are each made from a cellulose-based material, and wherein the strap is made from a different material.

14. The packaging of claim 9, wherein the first strap is separable from the handle via a perforated tear strip.

15. The packaging of claim 9, wherein the second strap is separable from the base box via perforated tear strip.

16. The packaging of claim 9, further comprising a cushioning element disposed on an interior bottom surface of the lower base box, the cushioning element comprising a corrugate comprising:

an upper panel and a lower panel cooperating to retain first and second serpentine elements configured to absorb force at opposing surfaces, wherein the upper panel and lower cooperate together to form an airflow aperture to damp movement of the corrugate, wherein the upper lid, lower base box, and handle are each made from a cellulose-based material.

17. The packaging of claim 9, wherein the strap is made from a material different than one of the upper lid, lower base box, and handle.

18. Packaging, comprising:

a lid comprising a handle disposed within a channel of a lid sidewall;

a base box, wherein the lid and base box in a closed configuration enclose a product; and a suspension mechanism removably fixing the handle and base box together such that lifting the handle lifts the base box, wherein the handle is vertically movable within the channel of the lid sidewall, and wherein the height of the lid is the same as the height of the base box.

* * * * *